US005599158A

United States Patent [19]

Ajilore

[11] Patent Number: 5,599,158

[45] Date of Patent: Feb. 4, 1997

[54] LINKAGE ARRANGEMENT FOR A WHEEL LOADER

[75] Inventor: Akin O. Ajilore, Macomb, Mich.

[73] Assignee: Caterpillar Inc., Peoria, Ill.

[21] Appl. No.: 345,888

[22] Filed: Nov. 28, 1994

[51] Int. Cl.[6] ..... E02F 3/38

[52] U.S. Cl. ..... 414/685; 414/722

[58] Field of Search ..... 414/685, 722, 414/723, 680, 686, 697; 37/468

[56] References Cited

U.S. PATENT DOCUMENTS

| | | | |
|---|---|---|---|
| 2,764,306 | 9/1956 | Dorkins . | |
| 3,254,780 | 6/1966 | Midtbo . | |
| 3,487,958 | 1/1970 | Shook et al. | 414/685 X |
| 3,890,696 | 6/1975 | Buske | 228/173 |
| 4,077,140 | 3/1978 | Branconi | 37/103 |
| 4,155,470 | 5/1979 | Moore et al. | 414/727 |
| 4,257,732 | 3/1981 | Staffanson | 414/685 X |
| 4,358,240 | 11/1982 | Shumaker | 414/694 |
| 4,529,460 | 7/1985 | Hasegawa et al. | 156/92 |
| 4,768,917 | 9/1988 | Garman | 414/697 |
| 4,813,163 | 3/1989 | Livingston et al. | 414/723 X |
| 5,152,659 | 10/1992 | Waka | 414/722 |

FOREIGN PATENT DOCUMENTS

| | | |
|---|---|---|
| 753209 | 7/1956 | Germany . |
| 3922870 | 1/1990 | Germany . |
| 61-221426 | 10/1986 | Japan . |

*Primary Examiner*—Donald W. Underwood
*Attorney, Agent, or Firm*—William C. Perry

[57] ABSTRACT

In the operation of a wheel loader the linkage arrangement that mounts the bucket to the machine often utilizes multiple lift arms and tilting components to accommodate the loading encountered in the various excavation operations. In many instances this hampers visibility to the bucket and also greatly increases the overall weight of the linkage arrangement. The present invention provides a linkage arrangement that utilizes a single boom-type lift arm and a tilting arrangement that is substantially centered along a vertical plane in which the linkage arrangement is moved. In addition, the individual components of the linkage are specifically contoured to provide a sufficient amount of mass in critical areas of loading and reduced areas of mass in non-critical areas. The result is a linkage arrangement that provides excellent visibility to the bucket with greatly reduced overall weight.

11 Claims, 2 Drawing Sheets

LINKAGE ARRANGEMENT FOR A WHEEL LOADER

TECHNICAL FIELD

This file relates to a loader linkage for a wheel loader having a box section lift arm and more particularly to a loader linkage having components that are configured to resist twisting forces that are applied to the linkage during operation.

BACKGROUND ART

In the operation of earthworking machines such as wheel loaders it is common practice to mount a bucket to the front of the machine by a pair of lift arms. Each lift arm is spaced from one another a distance that is slightly more narrow that the width of the bucket. The lift arms and therefore the bucket, are normally raised and lowered in a generally vertical plane by a pair of lift cylinders that are connected to each lift arm. A tilting arrangement for the bucket is provided in one of may types of linkage arrangements that are connected between the lift arm and the bucket and are actuated by a tilt cylinder that extends from the wheel loader to the tilt linkage arrangement to pivot the bucket with respect to the lift arm. One of the major drawbacks to this type of arrangement is that the visibility to the corner of the bucket is obstructed by the spread relationship of the lift arms, in the event that the design of the tilt linkage is such that it too is spread, the tilt linkage may also hinder visibility to the bucket.

One remedy for this situation is to provide a lift arm that is one piece and is positioned between the bucket and the machine generally along the centerline of the machine. One such design is disclosed in U.S. Pat. No. 4,768,917 issued to Anthony L. Garman on Sep. 6, 1988. While this design does improve the visibility to the corners of the bucket, the overall linkage configuration, especially in the area of the tilting arrangement is configured such that an excessive amount of mass is required in the areas of high stress. Since the tilt lever is connected to the bucket at the upper mid-portion thereof, the tilt linkage must be sized to accommodate twisting forces transferred through the arrangement during the loading of the bucket. The increase in mass and additional componentry will dramatically increase the weight of the linkage arrangement and thereby adversely affect the performance capability of the linkage.

DISCLOSURE OF THE INVENTION

In one aspect of the present invention a linkage arrangement is provided for mounting a bucket to a wheel loader for movement in a generally vertical plane. The linkage arrangement includes a lift arm having a first bifurcated end portion pivotally mounted to the wheel loader at spaced locations. A second bifurcated end portion is pivotally mounted to the bucket at spaced locations. A tilt lever is provided that has a first bifurcated end portion pivotally mounted to the bucket at spaced locations that are positioned elevationally above the connections between the second end portion of the lift arm and the bucket. The tilt lever also has a second end portion. A tilt link is provided that has a generally uniform configuration. The tilt link has a first end portion pivotally mounted to the lift arm and a second end portion pivotally mounted to the tilt lever at a point that is substantially intermediate the end portions of the tilt lever. A tilt cylinder is provided that has a first end portion mounted to the wheel loader and a second end portion mounted to the second end portion of the tilt lever. The tilt cylinder is actuatable to pivot the bucket about its mounting with the lift arm.

With the linkage arrangement set forth above, the transfer of forces through the linkage arrangement is substantially improved due to the specific configuration of the various components within the linkage arrangement. In addition to the improvement in force transfer, the overall weight of the linkage arrangement is tremendously reduced.

BEST MODE FOR CARRYING OUT THE INVENTION

Figure 1:
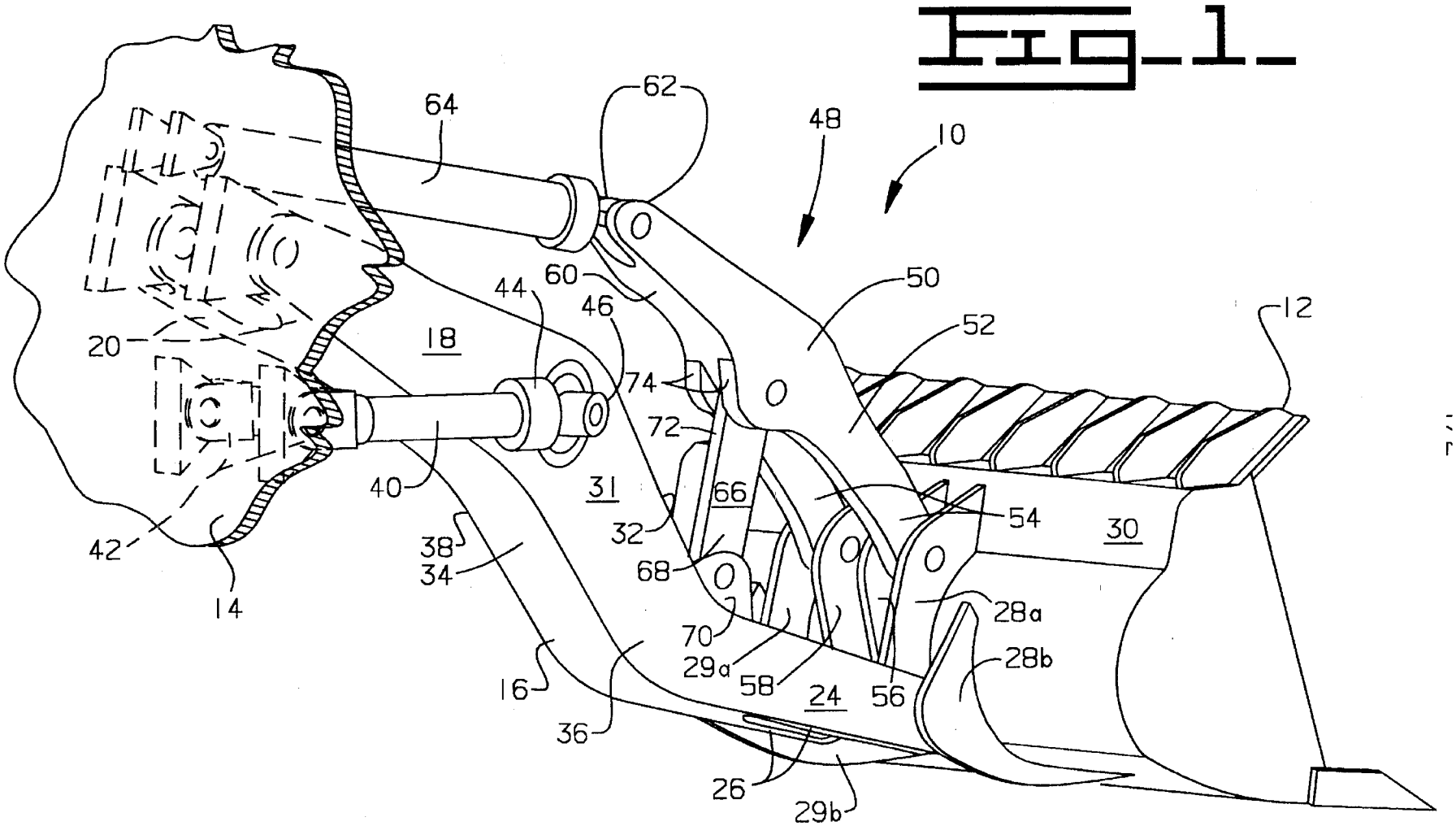
FIG. 1 is a diagrammatic perspective view of a wheel loader linkage arrangement that embodies the principles of the present invention and is taken from a position that is behind the bucket.

Referring to the drawings it can be seen that a linkage arrangement 10 is provided to connect a work implement, or bucket 12 to a frame 14 of a wheel loader. The linkage arrangement includes a main support boom or lift arm 16 that extends directly between the bucket and the frame. The lift arm 16 is shown to be a one piece boom member that has a first bifurcated end portion 18 that defines a pair of arms 20 that are spaced from one another. Each arm 20 is pivotally mounted to the frame 14. A second end portion 24 is also bifurcated to form a pair of arms 26, each of which is pivotally connected to a first pair of plates 28*a* and 28*b* and second pair of plates 29*a* and 29*b* that extend from the rear portion 30 of the bucket 12 at spaced locations from one another. The end portions of the lift arm are joined by a connecting portion 31 that is generally rectangular in cross-section and defines an upper and lower surface 32 and 34 respectively, and a pair of opposing side surfaces 36 and 38.

Figure 2:
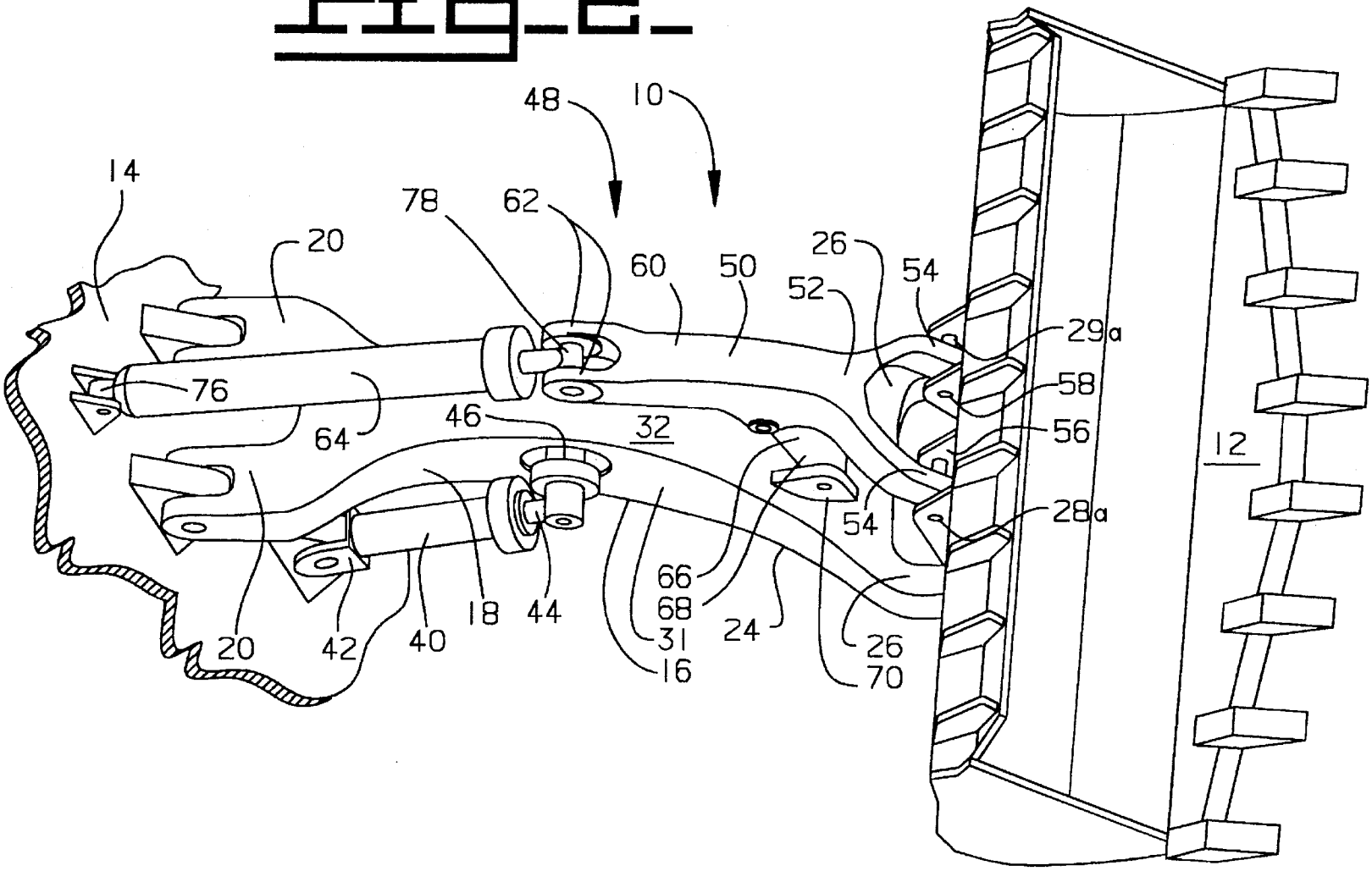
FIG. 2 is a diagrammatic perspective view of the wheel loader linkage shown in FIG. 1 taken from a position that is elevationally above the linkage.

The lift arm is positioned along a generally centrally disposed vertical plane that extends forward from the wheel loader and passes through the center of the bucket 12. The lift arm is moved along the vertical plane by a pair of lift cylinders 40 that are positioned on opposite sides of the lift arm 16. A first end portion 42 of each lift cylinder is pivotally mounted to the frame 14 while a second end portion 44 is pivotally mounted to one of a pair of projections 46 that extend from the respective side surfaces 36 and 38 of the lift arm. The projections 46 are located generally at the midportion of the lift arm. As is best shown in FIG. 2, the connecting portion 31 has a width that is narrowed with respect to the end portions so that a portion of each of the arms 20 overlies each of the lift cylinders to reduce the overall width of the structure. In order to provide the contouring of the lift arm it is envisioned that the lift arm will consist of a one piece casting however, it could be made by welded fabrication without departing from the intent of the invention.

The bucket is pivoted about its mounting with the arms 26 of the lift arm by a tilting arrangement 48. The tilting arrangement includes a tilt lever 50 that has a first end portion 52 that is bifurcated to define a pair of arms 54. One of the arms 54 is positioned between plate 28*a* and a plate 56 that extends from the rear portion 30 of the bucket and is pivotally mounted thereto. The other of the arms 54 is positioned between plate 29*a* and a plate 58 that extends from the rear portion 30 of the bucket. It can be seen that plates 28*a* and 29*a* extend substantially the entire length of the rear portion of the bucket and define a common mounting for both the lift arm and the tilt lever. The positioning of the mounting between the arms 54 and the bucket is elevationally above mounting between the lift arms and the bucket and is spaced slightly inwardly toward the vertical plane passing through the center of the bucket. A second end portion 60 extends rearwardly from the bucket and defines a clevis 62 that is connected to a tilt cylinder 64 in a manner to be described in greater detail hereinafter.

The tilt lever 50 is connected to the lift arm 16 by a tilt link 66. The tilt link has a generally uniform, rectangular configuration that has a first end portion 68 pivotally mounted to the lift arm 16. The first end portion 68 of the tilt link is positioned between a pair of upstanding flanges 70 that are mounted to the upper surface 32 of the lift arm at a location that is generally centered on the vertical plane. The second end portion 72 of the tilt link 66 is positioned between a pair of downwardly directed plates 74 that are positioned substantially at the midportion of the tilt lever 50 and is pivotally connected thereto.

The tilt cylinder 64 has a first end portion 76 that is connected to the frame 14 of the wheel loader. The tilt cylinder extends forwardly from the frame to define a second or rod end portion 78 that is positioned within the clevis 62 defined by the second end portion 60 of the tilt lever 50 as previously described. The tilt cylinder, along with the lift arm, the tilt lever, the tilt link, is substantially centered along the vertical plane extending between the wheel loader and the center of the bucket.

Industrial Applicability

In operation, a wheel loader is utilized to excavate material by driving the bucket 12 into a pile of material under motive force of the machine. The lift cylinders 40 are extended and the tilt cylinder 64 is retracted in coordination with one another to break the material loose, fill the bucket and lift the material from the pile. The material may then be loaded into a nearby dump truck or the wheel loader may be driven to a remote site to dump the material from the bucket. As the loading of the bucket takes place, it is very beneficial for the operator of the wheel loader to be able to see the corners of the bucket. This is not only important when working in close quarters at ground level but also when dumping material in the bed of a truck. With respect to truck loading, the bucket is rotated to dump the material from the bucket and the lower edge of the bucket often is moved below the elevation of the side of the truck. When the operator has good visibility, he can readily see when the bucket has been racked back an amount sufficient to clear the sides of the truck.

In addition to visibility, load transfer through the linkage is also a major consideration. As the bucket engages the material and during the manipulation of the linkage to fill the bucket, rather severe loading can be transferred from the bucket back through the linkage arrangement. In some material the loading will be uneven, for example when a rather large rock is encountered at one corner of the bucket, a twisting force will be applied to the linkage arrangement.

With the linkage arrangement set forth above, it can be seen that most of the components of the linkage arrangement are positioned on the vertical plane through which the linkage is moved during operation. In addition the lift arm is contoured such that the lift arms are mounted very closely to the plane in which the linkage moves. The combination of these factors places the structure towards the middle of the linkage arrangement thus permitting relatively unobstructed view to the corners of the bucket. In addition, the components are specifically configured to withstand the loading encountered during excavation. Specifically, the tilt lever 50 having a bifurcated second end portion 60 is mounted to the bucket at locations that are spaced from one another a distance that is slightly less than the distance between the connections between the lift arm and the bucket. Being so positioned, a resistance to structural displacement of the linkage arrangement due to uneven loading is provided. Even further, the construction of the linkage arrangement is such that each component is specifically configured so that sufficient mass is provided only in those areas where loading will occur. In doing so, each component can be contoured to reduce mass in the areas where the loading will not be severe. This results in a linkage arrangement having an overall weight that is greatly reduced, thus enhancing its performance capability.

Other aspects, objects and advantages of this invention can be obtained from a study of the drawings, the disclosure and the appended claims.

I claim:

1. A linkage arrangement for mounting a bucket to a wheel loader for movement in a generally vertical plane, comprising:

a lift arm having a first bifurcated end portion pivotally mountable to the wheel loader at spaced locations and a second bifurcated end portion pivotally mountable to a pair of mounting plates defined by the bucket at spaced locations;

a tilt lever having a first bifurcated end portion pivotally mountable to the mounting plates defined by the bucket at spaced locations that are laterally adjacent and positioned elevationally above the connections between the second end portion of the lift arm and the bucket and a second end portion;

a singular tilt link having a generally uniform configuration, said tilt link having a first end portion pivotally mounted to an upper surface of the lift arm and a second end portion pivotally mounted to the tilt lever at a point that is substantially intermediate the end portions of the tilt lever; and a tilt cylinder having a first end portion mountable to the wheel loader and a second end portion mounted to the second end portion of the tilt lever.

2. The linkage arrangement as set forth in claim 1 wherein the bucket is moveable in the vertical plane by a pair of lift cylinders connectable to the wheel loader and connected to opposite sides of the lift arm.

3. The linkage arrangement as set forth in claim 2 wherein each lift cylinder has a first end portion connectable to the wheel loader and a second end portion that is pivotally connected to one of a pair of projections that extend from opposing side surfaces defined by the lift arm at a point that is substantially intermediate the first and second end portions of the lift arm.

4. The linkage arrangement as set forth in claim 1 wherein the first end of the tilt link is mounted between a pair of upstanding flanges that extend from an upper surface defined by the lift arm.

5. The linkage arrangement as set forth in claim 1 wherein the second end portion of the tilt lever is bifurcated to form a pair of flanges that are spaced from one another a distance sufficient to receive the second end portion of the tilt cylinder.

6. The linkage arrangement as set forth in claim 1 wherein the lift arm, the tilt lever, the tilt link and the tilt cylinder are all substantially centered along the vertical plane.

7. The linkage arrangement as set forth in claim 1 wherein the lift arm is a one piece casting.

8. The linkage arrangement as set forth in claim 1 wherein the first and second end portions of the lift arm are connected by a connecting portion that has a width that is less than that of the first end portion.

9. The linkage arrangement as set forth in claim 1 further comprising a pair of first mounting plates attachable to a rear portion of the bucket at laterally spaced locations on opposite sides of the vertical plane, each said mounting plate extending in a generally vertical direction and having a lower end portion connected to one of the bifurcations of the lift arm and an upper portion connected to one of the bifurcations of the tilt lever.

10. The linkage arrangement as set forth in claim 9 wherein a second mounting plate is spaced from the lower portions of each of the first mounting plates in an outward direction with respect to the vertical plane, said spacing between the first and second mounting plates being sufficient to receive one of the respective bifurcations defined by the lift arm for pivotal connection to the first and second mounting plates.

11. The linkage arrangement as set forth in claim 10 wherein a third mounting plate is spaced from the upper portions of each of the first mounting plates in a direction towards the vertical plane, said spacing between the first and third mounting plates being sufficient to receive one of the respective bifurcations defined by the tilt lever for pivotal connection to the first and third mounting plates.

* * * * *